US007439947B2

(12) United States Patent
Ko et al.

(10) Patent No.: US 7,439,947 B2
(45) Date of Patent: Oct. 21, 2008

(54) LIQUID CRYSTAL DISPLAY DRIVING CIRCUIT AND DISPLAY UTILIZING THE SAME

(75) Inventors: Hong Pin Ko, Hsinchu (TW); Jun-Chang Chen, Taichung (TW)

(73) Assignee: TPO Displays Corp., Chu-Nan (TW)

( * ) Notice: Subject to any disclaimer, the term of this patent is extended or adjusted under 35 U.S.C. 154(b) by 578 days.

(21) Appl. No.: 11/073,353

(22) Filed: Mar. 4, 2005

(65) Prior Publication Data

US 2005/0195151 A1 Sep. 8, 2005

(30) Foreign Application Priority Data

Mar. 4, 2004 (TW) ..... 93105676 A

(51) Int. Cl.
*G09G 3/36* (2006.01)

(52) U.S. Cl. ..... 345/100; 345/98

(58) Field of Classification Search ..... 345/87–100, 345/204

See application file for complete search history.

(56) References Cited

U.S. PATENT DOCUMENTS 5,815,129 A * 9/1998 Jung ..... 345/93
6,483,889 B2 * 11/2002 Kim et al. ..... 377/54
7,081,890 B2 * 7/2006 Park et al. ..... 345/204

* cited by examiner

*Primary Examiner*—Nitin Patel
(74) *Attorney, Agent, or Firm*—Liu & Liu

(57) ABSTRACT

A LCD panel driving circuit for controlling a LCD panel, the LCD panel comprising display units respectively connected to corresponding data and gate electrodes. The LCD panel driving circuit comprises a data driver, a first gate driver, and a second gate driver. The data driver outputs a video signal to the data electrodes, and determines the video signal polarity according to a polar control signal. The first gate driver is coupled to a first terminal of each gate electrode for output of a pulse signal to the corresponding gate electrodes. The second gate driver is coupled to a second terminal of each gate electrode for output of the pulse signal to the corresponding gate electrodes. The first gate driver and second gate driver determine whether the pulse signal is output according to an external clock signal and an internally shifted signal.

18 Claims, 3 Drawing Sheets

LIQUID CRYSTAL DISPLAY DRIVING CIRCUIT AND DISPLAY UTILIZING THE SAME

BACKGROUND

The present invention relates to a display panel and in particularly to a display panel having a bilateral driving circuit.

With technology development, display panel such as LCD panels or OLED panels have become larger. In order to control the large panels, conventional panel utilize a bilateral driving circuit which provides two gate drivers respectively disposed on both sides of the panel, and outputs driving signals from two sides of the panel, thereby avoiding delay of driving signals as a result of longer signal lines in a larger size panel. When the gate driver in any side outputs an erroneous driving signal, the erroneous signal will affect the corresponding gate electrodes, resulting in a line defect.

When the line defect occurs, the panel is repaired by a laser device under manual control. The laser device repairs the panel by cutting off a control line outputting the erroneous driving signal to the gate electrode. This method however is costly and time consuming and requires human intervention.

SUMMARY

Accordingly, an aspect of this invention provides a display panel driving circuit for isolating control lines outputting erroneous driving signals from a gate driver with reduced production time and labor.

Another aspect of this invention provides a display panel utilizing the display panel driving circuit for increasing yield.

One embodiment of the present invention provides a display panel driving circuit for controlling a display panel. The display panel comprises display units respectively connected to corresponding data and gate lines. The display panel driving circuit comprises a data driver, a first gate driver, and a second gate driver. The data driver outputs a video signal to the data electrodes via data lines, and determines the video signal polarity according to a polarity control signal. The first gate driver is coupled to a first terminal of each gate line for outputting a first pulse signal to corresponding gate electrodes. The second gate driver is coupled to a second terminal of each gate line for outputting a second pulse signal to corresponding gate electrodes. The first gate driver and the second gate driver generate an internally shifted signal based upon an external clock signal and determines the output of the pulse signal according to the external clock signal and the internally shifted signal.

Another embodiment of the invention further provides a display device comprising a display panel, a data driver, a first gate driver, and a second gate driver. The display panel comprises a plurality of display units respectively connected to corresponding data and gate lines. The data driver outputs a video signal to the data electrodes via data lines, and determines the video signal polarity according to a polarity control signal. The first gate driver is coupled to a first terminal of each gate line for outputting a first pulse signal to corresponding gate electrodes. The second gate driver is coupled to a second terminal of each gate line for outputting a second pulse signal to corresponding gate electrodes. The first gate driver and the second gate driver generate an internally shifted signal based upon an external clock signal and determine the output of the pulse signal according to the external clock signal and the internally shifted signal.

BRIEF DESCRIPTION OF THE DRAWINGS

Embodiment of the present invention can be more fully understood by reading the subsequent detailed description and examples with reference made to the accompanying drawings, wherein.

DETAILED DESCRIPTION

Figure 1:
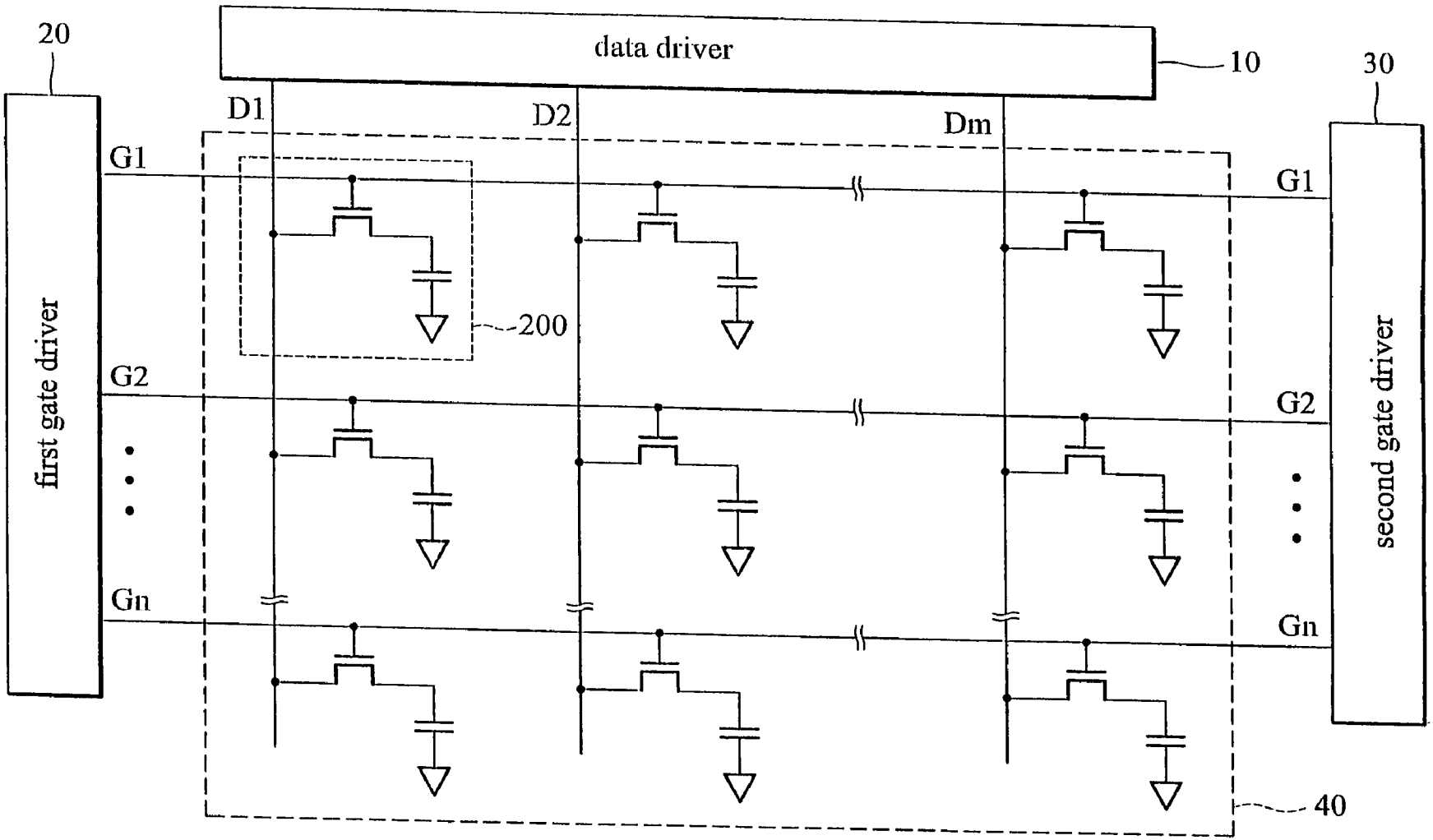
FIG. 1 is a schematic diagram of a display panel and the peripheral driving circuit according to an embodiment of the invention.

FIG. 1 is a schematic diagram of a display device and the peripheral driving circuit according to an embodiment of this invention. As shown in FIG. 1, the display device comprises a display panel 40, a data driver 10, a first gate driver 20, a second gate driver 30. The display panel 40 can be any types of display elements, such as a liquid crystal display (LCD) panel, an organic electro-luminance display (OLED) panel or a plasma display panel, and comprises display units 200 respectively connected to corresponding data electrodes and lines D1~Dm and corresponding gate electrodes and lines G1~Gn. The data driver 10 outputs a video signal to the data lines D1~Dm, and determines the video signal polarity according to a polarity control signal (not shown). The first gate driver 20 is coupled to a first terminal of each of gate lines G1~Gn for output of a pulse signal to the corresponding gate electrode. The second gate driver 30 is coupled to a second terminal of each gate line G1~Gn for output of the pulse signal to the corresponding gate electrode. The first gate driver 20 and second gate driver 30 determine whether the pulse signal is output according to an external clock signal and an internally shifted signal. When the first gate driver 20 or second gate driver 30 determines that a pulse signal is erroneous, the corresponding gate driver halts output thereof.

Figure 2:
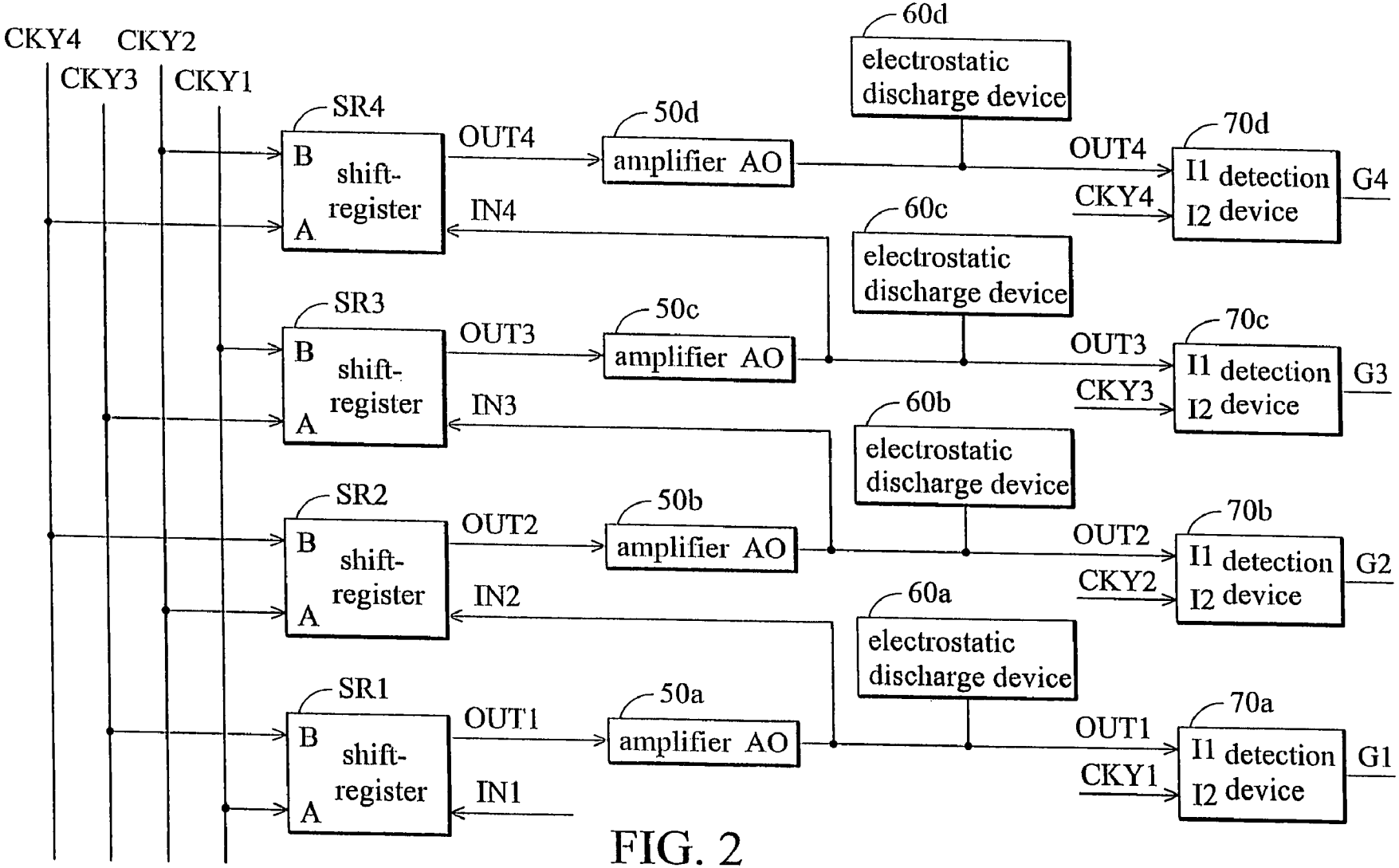
FIG. 2 is an internal diagram of a gate driver.

FIG. 2 is an internal diagram of a gate driver. Only the first gate driver 20 is described herein as an example as the first gate driver 20 and the second gate driver 30 may be the same. The first gate driver 20 drives gate lines G1~Gn with the following description disclosing the first gate driver 20 controlling gate lines G1~G4, for clarity. The first gate driver 20 comprises shift-register units SR1~SR4, detection devices 70*a*~70*d*, amplifiers 50*a*~50*d*, and electrostatic discharge devices 60*a*~60*d*.

Each shift-register SR1~SR4 outputs an internally shifted signal OUT1~OUT4 according to one of the external clock signals CKY1~CKY4.

Each detection device 70*a*~70*d* detects one internally shifted signal OUT1~OUT4 and comprises a first terminal I1 receiving the corresponding internally shifted signal OUT1~OUT4, and a second terminal I2 receiving one external clock signal CKY1~CKY4 corresponding to OUT1~OUT4.

Each amplifier 50*a*~50*d* is connected between the corresponding shift-register SR1~SR4 and detection device 70*a*~70*d* for amplifying the corresponding internally shifted signal.

Each electrostatic discharge device 60*a*~60*d* is connected to the corresponding amplifier 50*a*~50*d* for avoiding electrostatic discharge damage to the LCD panel 40.

Each shift-register SR1~SR4 receives at least one external clock signal and then outputs an internally shifted signal. The logic level of the internally shifted signal output from the corresponding shift-register is equal to the logic level of one external clock signal received by the corresponding shift-register.

Description of the shift-register SR1 is provided herein as an example. The shift-register SR1 has two input terminals A and B. The input terminal A receives the external clock signal CKY1. The input terminal B receives the external clock signal CKY3. The logic level of the internally shifted signal OUT1 equals to the external clock signal CKY1 received by the input terminal A. When receiving external clock signals CKY1 and CKY3, the shift-register SR1 outputs the internally shifted signal OUT1 to the amplifier 50*a* for amplifying the internally shifted signal OUT1. The amplifier 50*a* outputs the amplified internally shifted signal OUT1 to the detection device 70*a*. The detection device 70*a* receives the amplified internally shifted signal OUT1 and the external clock signal CKY1.

When the amplified internally shifted signal OUT1 is erroneous, the logic level of the amplified internally shifted signal OUT1 and that of the external clock signal CKY1 are different. Therefore the detection device 70*a* does not output the amplified internally shifted signal OUT1, also known as the pulse signal, to the gate line G1. When the amplified internally shifted signal OUT1 is correct, the logic level of the amplified internally shifted signal OUT1 and that of the external clock signal CKY1 are the same. The detection device 70*a* outputs the internally shifted signal OUT1, also known as the pulse signal, to the gate line G1.

The first gate driver 20 and second gate driver 30 respectively comprise detection devices for detecting internally shifted signals. When internally shifted signals are correct, detection devices within the first gate driver 20 and second gate driver 30 will output pulse signals to gate electrodes. If one internally shifted signal is erroneously detected by one detection device within the first gate driver 20, the first gate driver 20 does not output the erroneous internally shifted signal, also known as the pulse signal, to the corresponding gate electrode. Therefore, the corresponding gate line G1 only receives the pulse signal from the second gate driver 30 thus preventing the gate electrode and line from receiving different pulse signals. The detection device detects the internally shifted signal, also known as the pulse signal, and thus automatically prevents the erroneous pulse signal from being output to the corresponding gate electrode and line and thus eliminates the need for a laser device to cut off the control line outputting the erroneous pulse signal.

Figure 3:
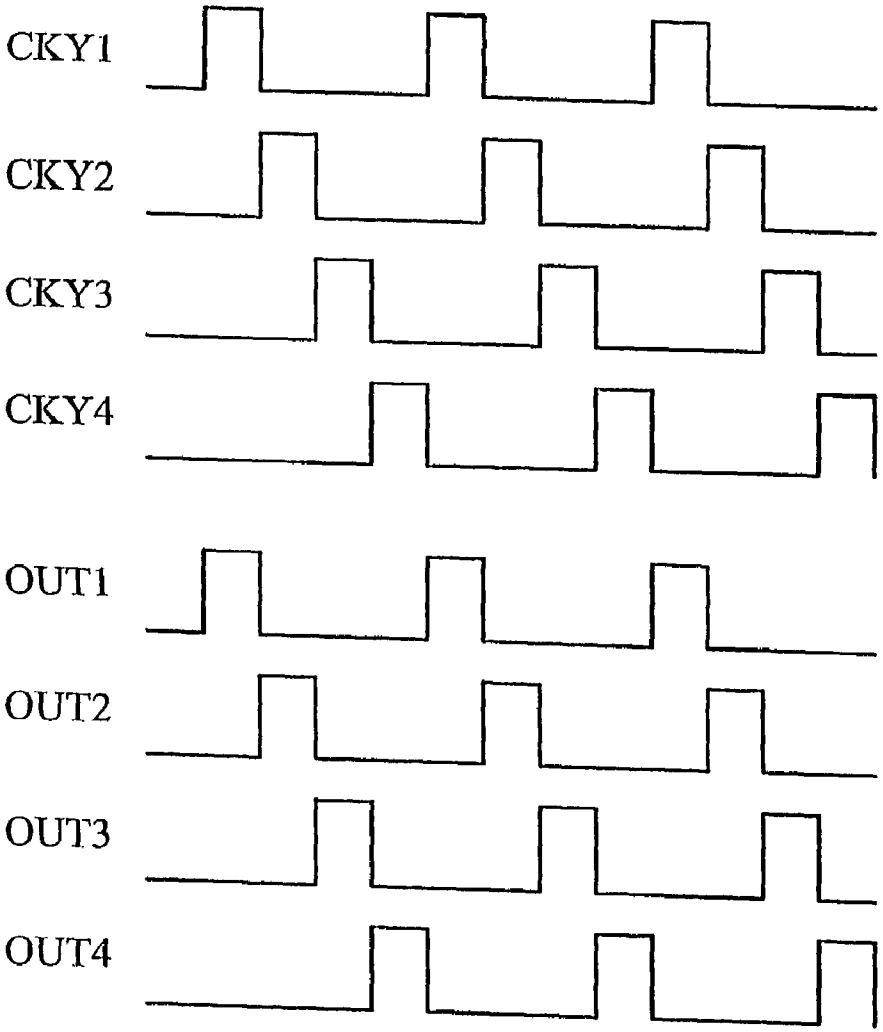
FIG. 3 is a timing chart of external clock signals and internally shifted signals according to an embodiment of the invention.

FIG. 3 is a timing chart of external clock signals and internally shifted signals according to an embodiment of this invention. In this embodiment, a first stage shift-register SR1, referring to FIG. 2, is illustrated. In this embodiment, when the input terminal A of shift-register SR1 receives the external clock signal CKY1, being a driving signal thereof, and the input terminal B of shift-register SR1 receives the external clock signal CKY3, the logic level of the internally shifted signal OUT1 is equal to that of the external clock signal CKY1. Therefore, the logic level of any internally shifted signal in following stages of shift registers is equal to the corresponding external clock signal received by the input terminal A of the corresponding shift-register.

In summary, advantages of embodiments of the invention are described in the following. The invention detects line defects in gate electrodes and auto-isolates an erroneous pulse signal thus reducing production time cost and labor. The invention further eliminates the need for a laser device to cut off a control line outputting the erroneous pulse signal, repairing the panel. Additionally, product yield can be increased.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A driving circuit for controlling a display panel comprising a plurality of display units, respectively connected to corresponding data and gate lines, the display panel driving circuit comprising:

a data driver outputting video signals to the data lines;

a first gate driver coupled to a first terminal of each gate line for outputting a first signal to the corresponding gate lines; and a second gate driver coupled to a second terminal of each gate line for outputting a second signal to the corresponding gate lines, wherein at least one of the first gate driver and the second gate driver generates an internally shifted signal based upon an external clock signal and determines the output of the shifted signal according to the external clock signal and the internally shifted signal, and wherein each of the first gate driver and the second gate driver comprises:

a plurality of shift-registers receiving a plurality of external clock signals, wherein each of the shift-registers outputs the internally shifted signal according to a corresponding clock signal among the external clock signals; and a plurality of detection devices, each detecting one shift-register and comprising a first terminal receiving the internally shifted signal output from a corresponding shift-register and a second terminal receiving the corresponding clock signal, wherein when the logic level of the internally shifted signal and that of the corresponding clock signal are different, the corresponding detection device does not output the shifted signal to the gate lines, and when the logic level of the internally shifted signal and that of the corresponding clock signal are the same, the corresponding detection device outputs the shifted signal to the gate lines.

2. The driving circuit as claimed in claim 1, further comprising a plurality of amplifiers each connecting between the corresponding shift-register and the corresponding detection device for amplifying the corresponding internally shifted signal.

3. The driving circuit as claimed in claim 2, further comprising a plurality of electrostatic discharge devices each connecting to the corresponding amplifier for avoiding electrostatic discharge damage to the display panel.

4. A display, comprising:

a display panel comprising a plurality of display units, respectively connected to corresponding data and gate lines; and a driving circuit as in claim 1.

5. The display as claimed in claim 4, further comprising a plurality of amplifiers each connecting between the corresponding shift-register and the corresponding detection device for amplifying the corresponding internally shifted signal.

6. The display as claimed in claim 5, further comprising a plurality of electrostatic discharge devices each connecting to the corresponding amplifier for avoiding electrostatic discharge damage to the display panel.

7. An electronic device comprising:

a display as in claim 4; and means operatively coupled to the display, for receiving display data to render an image by the display panel.

8. The driving circuit as claimed in claim 1, wherein at least one of the first gate driver and the second gate driver determines whether the corresponding first signal and second signal are in error, and if in error, does not output the corresponding first signal in error or second signal in error to the corresponding gate lines.

9. A method of driving display units in a display, said method comprising the steps of: providing a first driver for outputting a first signal to control a corresponding display unit; providing a second driver for outputting a second signal to control same corresponding display unit; and determining whether at least one of the corresponding first signal and second signal is in error, and if in error, not outputting the corresponding first signal and second signal to the corresponding display unit, wherein each pf the first driver and the second driver comprises a plurality of shift-registers, wherein each of the shift-registers outputs the corresponding first signal or second signal according to a corresponding clock signal, when the logic level of the corresponding first signal or second signal and that of the corresponding clock signal are different, not outputting the corresponding first signal in error or second signal in error to the corresponding display unit and wherein when the logic level of the corresponding first signal or second signal and that of the corresponding clock signal are the same, outputting the corresponding first signal or second signal to the corresponding display unit.

10. A method of driving display units in a display, said method comprising the steps of:

providing a first driver for outputting a first signal to control a corresponding display unit;

providing a second driver for outputting a second signal to control the same corresponding display unit; and determining whether at least one of the corresponding first signal and second signal are in error, and if in error, not outputting the corresponding first signal in error or second signal in error to the corresponding display unit.

11. A driving circuit for controlling a display comprising a plurality of display units, the driving circuit, comprising:

a first driver outputting a first signal to control a corresponding display unit; and a second driver outputting a second signal to control the same corresponding display unit;

wherein at least one of the first driver and the second driver determines whether the corresponding first signal and second signal are in error, and if in error, does not output the corresponding first signal in error or second signal in error to the corresponding display unit, and wherein each of the first driver and the second driver comprises a plurality of shift-registers, wherein each of the shift-registers outputs the corresponding first signal or second signal according to a corresponding clock signal, when the logic level of the corresponding first signal or second signal and that of the corresponding clock signal are different, not outputting the corresponding first signal in error or second signal in error to the corresponding display unit, and wherein when the logic level of the corresponding first signal or second signal and that of the corresponding clock signal are the same, outputting the corresponding first signal or second signal to the corresponding display unit.

12. The driving circuit as claimed in claim 11, wherein the plurality of shift-registers receive a plurality of external clock signals, wherein each shift-register outputs an internally shifted signal according to an external clock signal; and each of the first driver and the second driver comprises a plurality of detection devices each detecting one shift-register and comprising a first terminal receiving the internally shifted signal output from a corresponding shift-register and a second terminal receiving the corresponding clock signal, wherein when the logic level of the internally shifted signal and that of the corresponding clock signal are different, the corresponding detection device does not output the shifted signal to the corresponding display unit, and when the logic level of the internally shifted signal and that of the first clock signal are the same, the corresponding detection device outputs shifted signals to the corresponding display unit.

13. The driving circuit as claimed in claim 12 further comprising a plurality of amplifiers each connecting between the corresponding shift-register and the corresponding detection device for amplifying the corresponding internally shifted signal.

14. The driving circuit as claimed in claim 13, further comprising a plurality of electrostatic discharge devices each connecting to the corresponding amplifier for avoiding electrostatic discharge damage to the display.

15. A display, comprising:

a display panel comprising a plurality of display units; and a driving circuit as in claim 11 operatively connected to the plurality of display units.

16. The display as claimed in claim 15, further comprising a plurality of amplifiers each connecting between the corresponding shift-register and the corresponding detection device for amplifying the corresponding internally shifted signal.

17. The display as claimed in claim 16, further comprising a plurality of electrostatic discharge devices each connecting to the corresponding amplifier for avoiding electrostatic discharge damage to the display.

18. An electronic device comprising:

a display as in claim 15; and means operatively coupled to the display, for receiving display data to render an image by the display.

* * * * *